US005983054A

United States Patent [19]

Kameyama

[11] Patent Number: 5,983,054

[45] Date of Patent: Nov. 9, 1999

[54] METHOD AND IMAGE FORMING APPARATUS FOR PREVENTING THE USE OF UNSUITABLE PROCESS CARTRIDGES

[75] Inventor: Kenji Kameyama, Atsugi, Japan

[73] Assignee: Ricoh Company, Ltd., Tokyo, Japan

[21] Appl. No.: 09/233,063

[22] Filed: Jan. 20, 1999

[30] Foreign Application Priority Data

Jan. 20, 1998 [JP] Japan ..... 10-008706

[51] Int. Cl.[6] ..... G03G 15/00

[52] U.S. Cl. ..... 399/125; 399/25; 399/107; 399/262

[58] Field of Search ..... 399/12, 107, 110, 399/111, 124, 125, 262, 108, 109, 114

[56] References Cited

PUBLICATIONS

Patent Abstracts of Japan, JP 8–106207, Apr. 23, 1996.
Patent Abstracts of Japan, JP 9–185254, Jul. 15, 1997.

*Primary Examiner*—Robert Beatty
*Assistant Examiner*—Hoang Ngo
*Attorney, Agent, or Firm*—Oblon, Spivak, McClelland, Maier & Neustadt, P.C.

[57] ABSTRACT

An image forming apparatus having a cover and a process cartridge. The cover has a movable lever and swings over the image forming apparatus to an open position and to a closed position. The cover swings to the closed position only when the movable lever is in a predetermined position. The process cartridge is detachably installed when the cover is in the open position and is secured to the image forming apparatus when the cover is in the closed position. The process cartridge includes a projection that moves the movable lever of the cover to the predetermined position.

20 Claims, 6 Drawing Sheets

METHOD AND IMAGE FORMING APPARATUS FOR PREVENTING THE USE OF UNSUITABLE PROCESS CARTRIDGES

BACKGROUND OF THE INVENTION

1. Field of the Invention

The present invention relates to a method and apparatus for image forming, and more particularly to a method and apparatus for image forming that prevents the use of unsuitable process cartridges at a relatively low cost.

2. Discussion of the Background

Many image forming apparatuses such as copying machines, facsimile machines, printers and so forth, incorporate a so-called "process cartridge," which includes toner or ink as well as associated components for image processing. Typically, the process cartridge is detachably installed in the imaging forming apparatus in order to facilitate an operation for exchanging the cartridge or supplying toner (or ink) relative to the cartridge.

Each of these apparatuses is generally configured to accept a process cartridge which is specifically designed for it and to refuse other process cartridges. The reason for this is that the electrostatic image forming method using toner (or ink) requires techniques so delicate that the manufacturers of image forming apparatuses uniquely develop the toner, or the ink. Accordingly, by use of an incorrect process cartridge, (i.e., a process cartridge not specifically designed for use in a particular image forming apparatus) problems associated with quality of an image may arise, or the image forming apparatus may be damaged.

To avoid such a problem, many solutions have been developed. One exemplary technique is described in Japanese Laid Open Patent Publication No. 08-106207 (1996). This technique provides a toner tank portion of an image forming apparatus with projections corresponding to depressions provided to a specific toner cartridge so as to select only a specific toner cartridge. In this case, however, if the projections and/or the depressions are removed for any reason, the image forming apparatus may easily accept any cartridge even those which are incorrect.

Another exemplary technique is described in Japanese Laid Open Patent Publication No. 09-185254 (1997). This technique provides an image forming apparatus with a drive gear which meets only with a driven gear of a specific process cartridge so as to select only the specific process cartridge. In this case, however, the shape of the diverse gear for each type of the image forming apparatus is changed, and thus, the manufacturing cost may increase.

Therefore, it is believed that there is no image forming apparatus available which includes a reparable mechanism for preventing the use of unsuitable process cartridges at a relatively low cost.

SUMMARY OF THE INVENTION

Accordingly, an object of the present invention is to provide a novel image forming apparatus which prevents the use of unsuitable process cartridges at a relatively low cost.

To achieve these and other objects, an image forming apparatus includes a cover and a process cartridge. The cover has a movable lever, and swings over the image forming apparatus to an open position and to a closed position. The cover swings to the closed position only when the movable lever is in a predetermined position. The process cartridge is detachably installed when the cover is in the open position and is secured to the image forming apparatus when the cover is closed. Further, the process cartridge has a projection that moves the movable lever of the cover to the predetermined position.

The projection may be manufactured separately from the process cartridge and secured to a part of the process cartridge.

The projection may also be mounted on or around a handle of the process cartridge.

Additionally, the projection may be mounted on at least one side of the handle of the process cartridge.

Preferably, when the cover is in the closed position and the process cartridge is not in the image forming apparatus the movable lever rests in a position where the movable lever allows the cover to swing to the open position.

The image forming apparatus may further include a pushing member that pushes the movable lever and a stopper that stops the movable lever at a certain position.

Preferably, the movable lever is secured to an element which is mounted on the cover.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
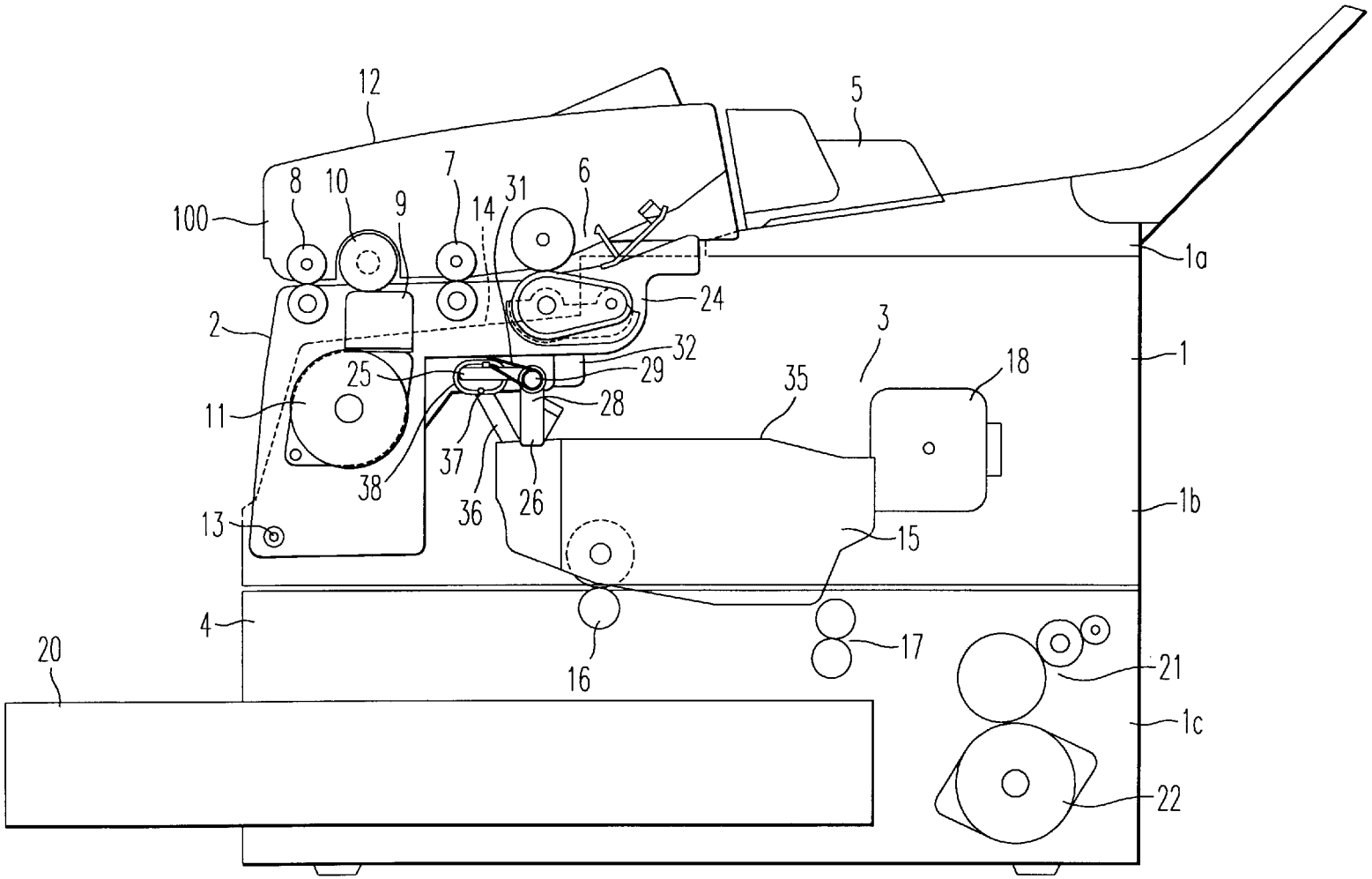
FIG. 1 is a sectional side view of a facsimile apparatus according to an embodiment of the present invention.

Referring now to the drawings, wherein like reference numerals designate identical or corresponding parts throughout the several views, and more particularly to FIG. 1 thereof, there is illustrated a facsimile apparatus according to the present invention. The present invention may not be limited to the embodiment being explained below and may be applied to any image forming apparatuses, such as copying machines, that use a "process cartridge." The facsimile apparatus of FIG. 1 includes a main enclosure 1, an image reading unit 2, an image forming unit 3, and a sheet supply unit 4. The main enclosure 1 includes an outer case, support frames, and so on, and is divided into an upper portion 1*a*, a mid portion 1*b*, and a lower portion 1*c*. The image reading unit 2 is fixed on the upper and mid portions 1*a* and 1*b* of the main enclosure 1. The image forming unit 3 is fixed on the mid portion 1*b* of the main enclosure 1. The sheet supply unit 4 is mounted on the lower portion 1*c* of the main enclosure 1.

The image reading unit 2 includes an original placement section 5, a sheet feed section 6, a pair of front feed rollers 7, a pair of rear feed rollers 8, a scanner 9, a pressure roller 10, a scanner drive motor 11, and so forth. The original placement section 5 for receiving originals to be read is secured on the top of the main enclosure 1. The sheet feed section 6 picks up a single sheet from a batch of originals placed on the original placement section 5 and feeds the single sheet forward. The transfer rollers 7 and 8 further advance the single sheet fed by the sheet feed section 6. The scanner 9 reads image information of the original sheet using an optical reading method. The scanner 9 is mounted between the front and rear rollers 7 and 8. The pressure roller 10 presses the original sheet relative to a reading surface of the scanner 9. The scanner drive motor 11 drives the scanner 9.

Such an image reading unit 2 forms an integrated unit with a console unit 12 which is mounted on the top thereof and which controls the facsimile apparatus and displays various machine conditions. The image reading unit 2 and console unit 12 together form a cover unit 100. The cover unit 100 is rotatably held on the mid portion 1*b* of the main enclosure 1 with a support axis 13 at a bottom side of the cover unit 100. With this configuration, the cover unit 100 has a closed position and an open position in which to settle or rest. In the open position, the cover unit 100 covers the inside the main enclosure 1, as illustrated in FIG. 1, and in the closed position the cover unit 100 makes an opening 14 so as to provide better accessibility to the inside of the main enclosure 1. The image forming unit 3 includes a process cartridge 15, an image transfer charger 16, a registration roller 17, a main motor 18, and so forth, and employs any known electrostatic image forming method. The process cartridge 15 includes primary elements (not shown) for electrostatic image processing, such as a photoconductor, a toner supply unit, a toner cleaning unit, a development unit, and so forth. The process cartridge 15 is detachably mounted on the mid portion 1*b* of the main enclosure 1. The image transfer charger 16, the registration roller 17, and the main motor 18 are mounted around the process cartridge 15.

The sheet supply unit 4 includes a sheet cassette 20, a sheet supply roller 21, and a sheet supply motor 22. The sheet cassette 20 carries sheets that are used for image printing. The sheet cassette 20 has one end protrudent from a side of the lower portion 1*c* of the main enclosure 1 and is detachably mounted in the lower portion 1*c* of the main enclosure 1. The sheet supply motor 22 drives the sheet supply roller 21 to pick up a single sheet out of the sheet cassette 20, and the single sheet is forwarded to the registration roller 17.

As illustrated in FIG. 1, the cover unit 1 00 further includes a unit frame 24, a horizontal lever 25, a vertical lever 26, a projection 27, a lever axis 29, a spring 31, and a stopper 32.

Figure 2:
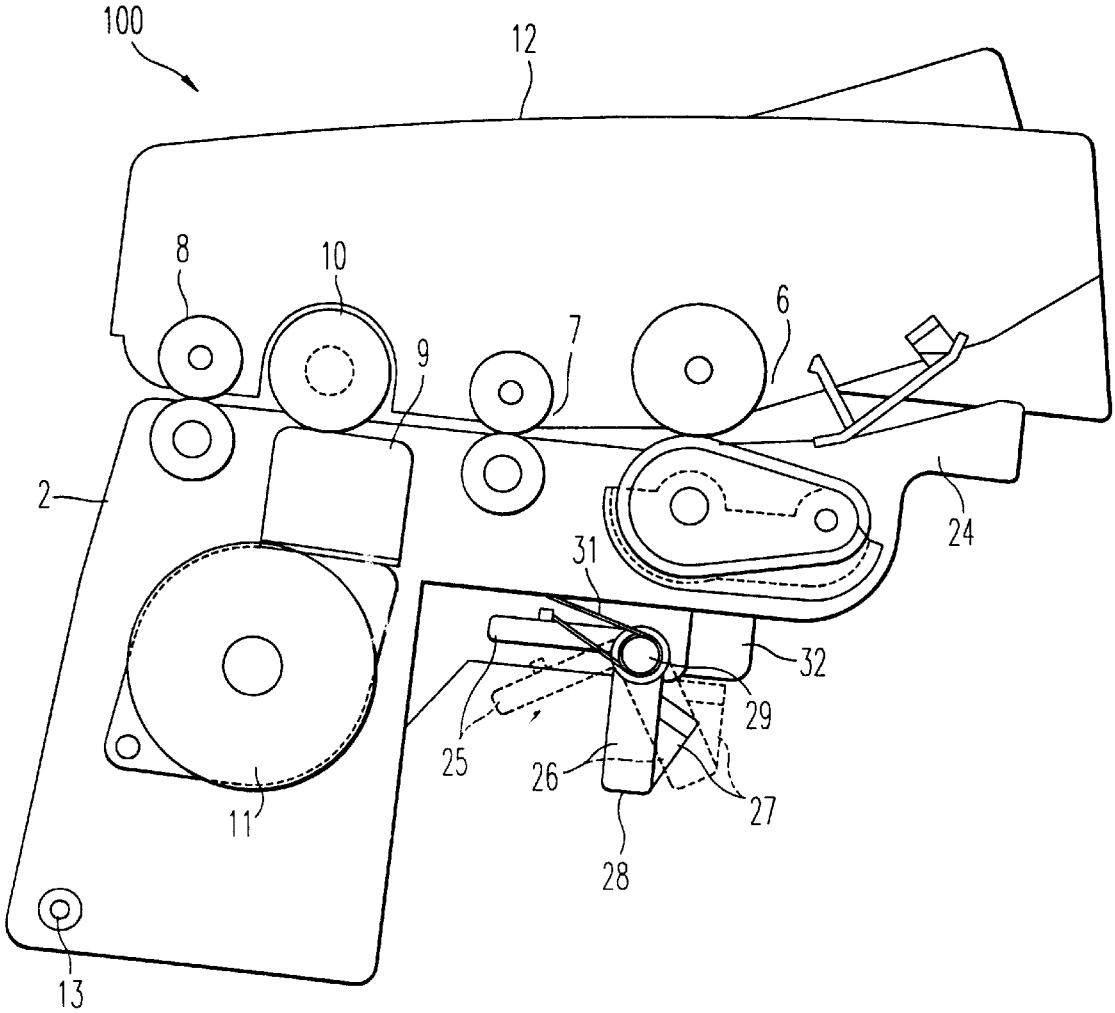
FIG. 2 is a sectional side view of a cover unit 100 of the facsimile apparatus of FIG. 1.

Referring to FIG. 2, the cover unit 100 is explained in further detail. As illustrated in FIG. 2, the horizontal lever 25, the vertical lever 26, and the projection 27 formed on a side of the vertical lever 26 are molded in one piece as a lever member 28. The unit frame 24 supports the above-mentioned various elements of the cover unit 100. The lever member 28 is rotatably mounted around the lever axis 29 at one side of the unit frame 24 inside the main enclosure 1.

The lever axis 29 is secured to a lower part of the unit frame 24, and the spring 31 is loaded around the lever axis 29. The spring 31 makes contact with the horizontal lever 25 applying pressure thereto so as to force the lever member 28 to rotate counterclockwise. The stopper 32 which is formed on a bottom side of the unit frame 24 makes contact with the projection 27 of the lever member 28 to stop a rotation thereof.

As illustrated in FIG. 1, the above-described process cartridge 15 includes additional parts other than the above-described primary elements for electrostatic image processing. The additional parts are an outer case 35, a handle 36, a pin 37, a fixing member 38, etc.

Figure 3:
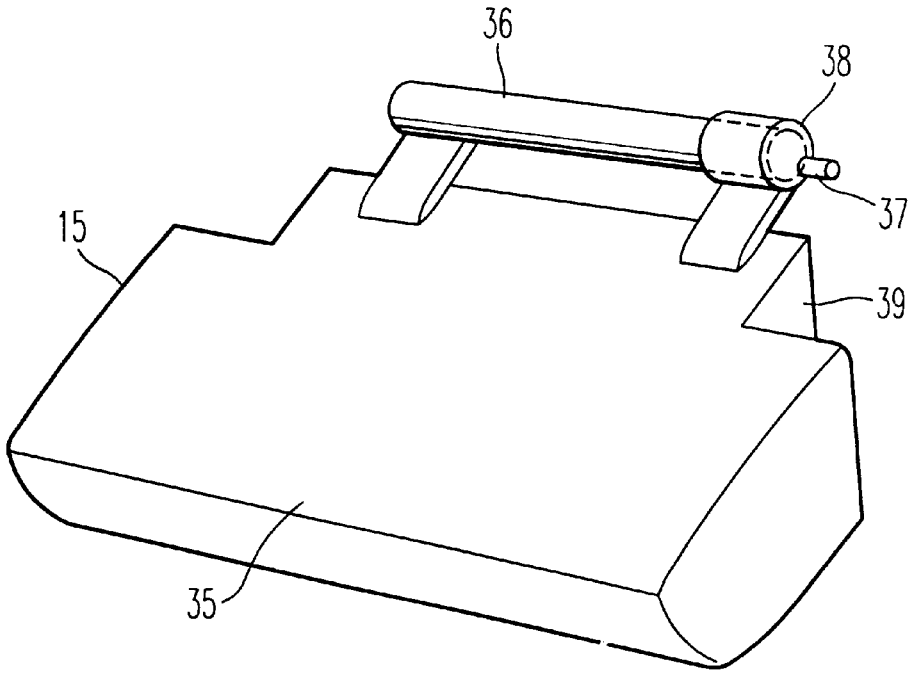
FIGS. 3 and 4 are illustrations of a process cartridge 15 of the facsimile apparatus of FIG. 1.
Figure 4:
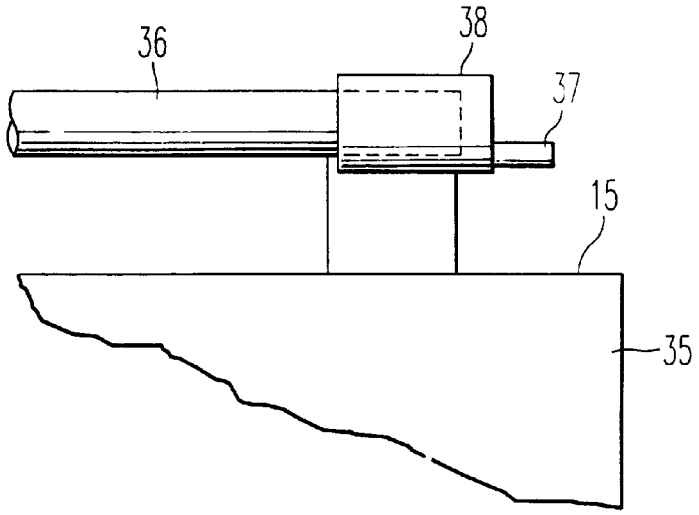

Referring to FIGS. 3 and 4, the rotation mechanism of the process cartridge 15 is explained. The handle 36 is formed on one side of the outer case 35 so that a user can carry the process cartridge 15 by the handle 36 for installation in, or removal from, an appropriate position in the main enclosure 1. The fixing member 38 is mounted on one side of the handle 36. As explained below, the pin 37 which is fixed on the fixing member 38, moves the lever member 28. Each side of the process cartridge 15 has a pit 39 so that the vertical lever 26 of the lever member 28 can move freely.

Figure 5:
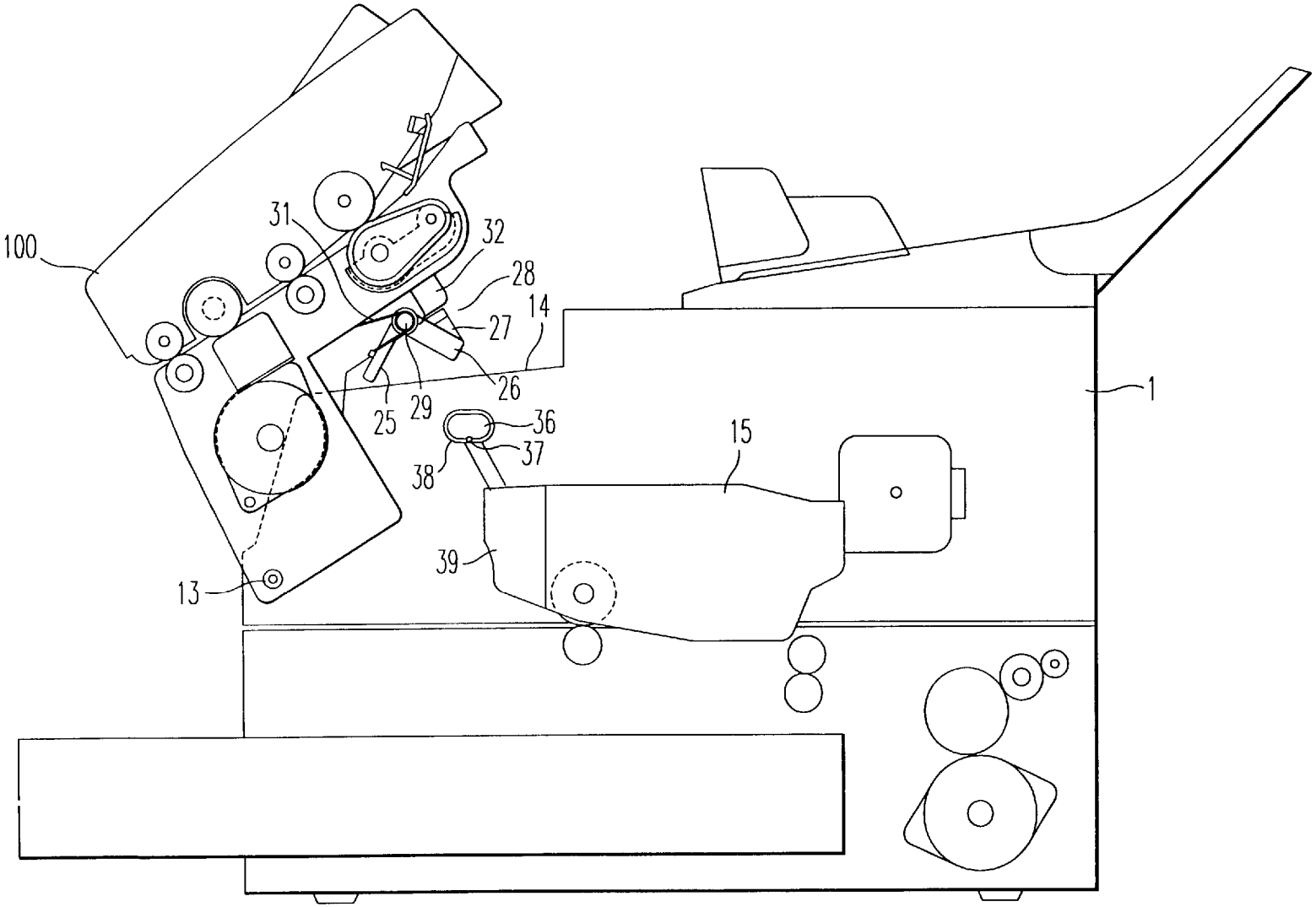
FIG. 5 is another sectional side view of the facsimile apparatus of FIG. 1 with the cover unit 100 in an open position.

Next, an operation of the lever member 28 and its associated elements during the removal of the process cartridge 15 is explained with reference to FIG. 5. As illustrated in FIG. 5, when the cover unit 100 is in the open position and the opening 14 appears, the lever 28 of the cover unit 100 is forced to move counterclockwise around the lever axis 29 by the spring 31 until the projection 27 hits the stopper 32 to stop the rotation of the lever member 28 (see the chain lines of FIG. 2).

The process cartridge 15 may be properly placed in a predetermined position with the cover unit 100 settled in either the closed positions or the open position, as illustrated in FIGS. 1 and 5, respectively. When the cover unit 100 moves from the open position (FIG. 5) to the closed position (FIG. 1), the pin 37 pushes the horizontal lever 25 upwards against the force of the spring 31 and, then, the lever member 28 rotates clockwise so that the vertical lever 26 enters into the pit 39 of the process cartridge 15. When the cover unit 100 moves from the closed position (FIG. 1) to the open position (FIG. 5), the vertical lever 26 comes out of the pit 39 without being hindered by any part of the process cartridge 15, and the spring 31 pushes the lever 28 downwards so that the lever 28 rotates counterclockwise until the projection 27 hits the stopper 32 to stop the rotation of the lever member 28, as described above. In this way, the cover unit 100 can move freely between the open and closed positions. In addition, the cover unit 100 includes a lock mechanism (not shown) for securing the cover unit 100 in the closed position (FIG. 1).

Figure 6:
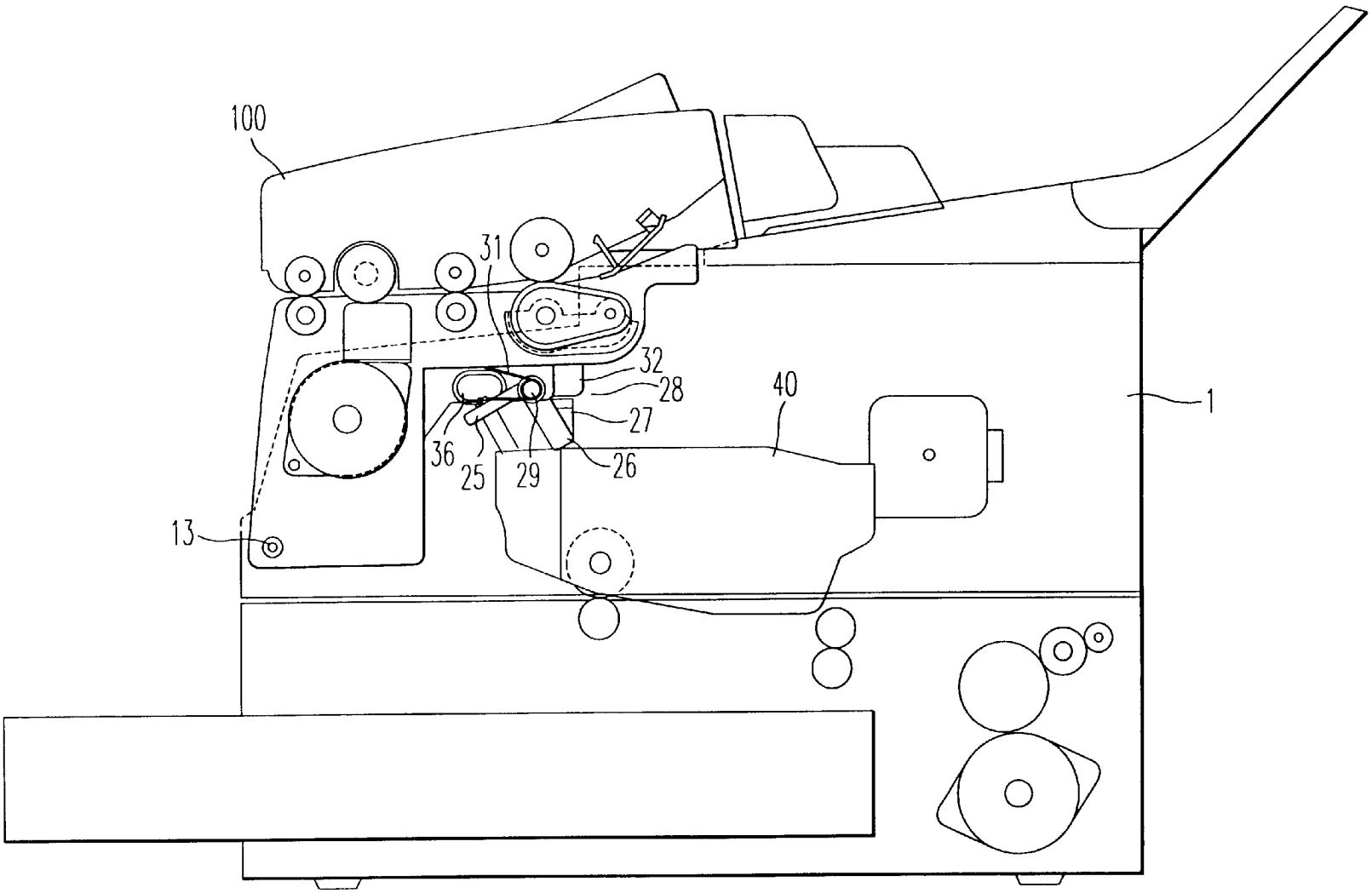
FIG. 6 is another sectional side view of the facsimile apparatus of FIG. 1 with the cover unit 100 in a closed position.

When an incorrect process cartridge 40 is placed in the facsimile apparatus by mistake, as illustrated in FIG. 6, the cover unit 100 cannot settle properly in the closed position. Since the pin 37 is unique to the example being explained, the incorrect process cartridge 40 has no such pin. Therefore, in FIG. 6, the lever member 28 of the cover unit 100 does not receive any force causing it to rotate clockwise and remains in the position as illustrated in FIG. 5. At this time, the projection 27 of the lever member 28 is in contact with the stopper 32 and the vertical lever 26 of the lever member 28 is in contact with an upper part of the incorrect process cartridge 40. Therefore, the cover unit 100 cannot reach the closed position, as illustrated in FIG. 6. In this case, the user can notice that an incorrect process cartridge has been placed in the facsimile apparatus. It may also be preferable to provide an appropriate warning mechanism for informing the user that an incorrect process cartridge has been placed in the facsimile apparatus.

Figure 7:
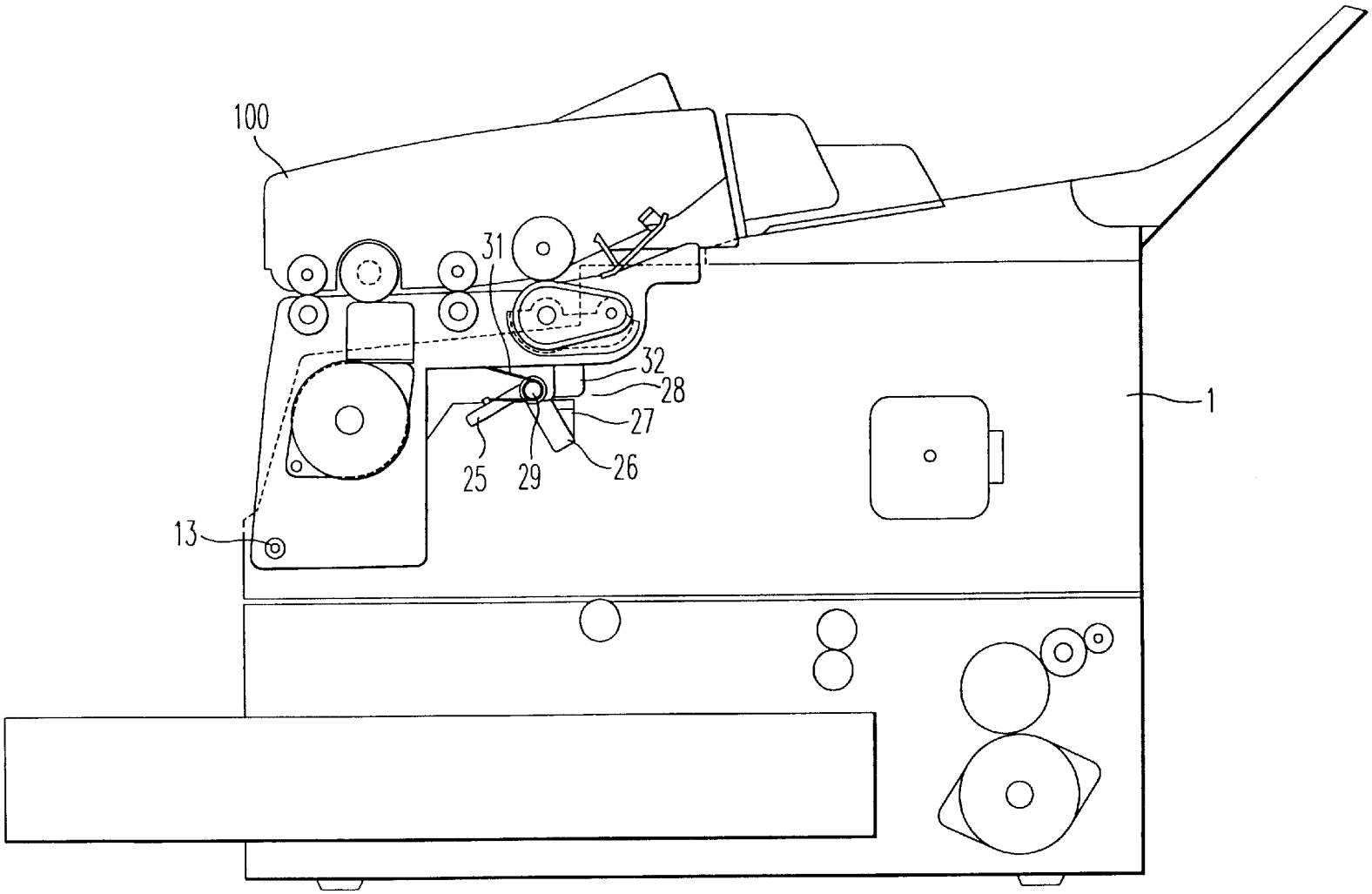
FIG. 7 is another sectional side view of the facsimile apparatus of FIG. 1 with the cover unit 100 closed and the process cartridge uninstalled.

When no process cartridge is installed in the facsimile apparatus, as illustrated in FIG. 7, the lever member 28 does not make contact with any parts that interfere with the free movement of the cover unit 100.

With the above-described configurations of the cover unit 100 and the process cartridge 15, the installation of the correct process cartridge 15 permits the cover unit 100 to settle in the closed position, while the installation of an incorrect process cartridge does not. Thus, the above-described configuration protects against the use of an incorrect process cartridge in the facsimile apparatus.

Preferably, the pin 37 is fixed on or around the handle 36 so that correct process cartridges are visibly distinguishable from incorrect process cartridges.

Further, the pin 37 is preferably fixed on only one side of the handle 36. Also, the lever member 28 is mounted on the corresponding side of the cover unit 100. Thus, there are at least two different positions of both lever member 28 and the pin 37.

Still further, the pin 37 may be fixed on each side of the handle 36. Also, the lever member 28 is mounted on each corresponding side of the cover unit 100.

The lever member 28, which is supported by the lever axis 29, may be supported by an element other than the lever axis 29. Such an element may be the lock mechanism discussed above for the cover unit 100. Furthermore, the lever axis 29 may be used for functions other than supporting the lever member 28.

The pin 37 may be molded in one piece with the handle 36 or any other element associated with the process cartridge 15. However, by having the pin 37 produced separately from the rest of the process cartridge and assembled at a later time, different process cartridges (i.e., process cartridges having different pins or pin locations) can be manufactured using a single shape for the rest of the process cartridge. Moreover, even if the pin 37 is damaged, the use of incorrect process cartridges can still be prevented by replacing the pin 37.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Obviously, numerous additional modifications and variations of the present invention are possible in light of the above teachings. It is therefore to be understood that within the scope of the appended claims, the present invention may be practiced otherwise than as specifically described herein.

This application is based on Japanese Patent Application No. 10-008706 filed in the Japanese Patent Office on Jan. 20, 1998, the entire contents of which are hereby incorporated by reference.

I claim:

1. An image forming apparatus, comprising:

a body;

a cover including a movable lever, said cover being configured to swing to an open position and to a closed position relative to said body, said cover being configured to swing to said closed position only when said movable lever is in a predetermined position; and a process cartridge configured to be detachably installed in said body and secured to said body when the cover is in the closed position, said process cartridge including a projection configured to move said movable lever of said cover to said predetermined position.

2. The image forming apparatus of claim 1, wherein said projection is separately manufactured from said process cartridge and is secured to a part of said process cartridge.

3. The image forming apparatus of claim 1, wherein said process cartridge comprises:

a handle, said projection being mounted on or around the handle of said process cartridge.

4. The image forming apparatus of claim 3, wherein said projection is mounted on at least one side of said handle of said process cartridge.

5. The image forming apparatus of claim 1, wherein said movable lever is configured to sit in a rest position that permits said cover to swing from said closed position to said open position when the process cartridge is detached from said body.

6. The image forming apparatus of claim 1, wherein said cover comprises:

a pushing member configured to push said movable lever away from said predetermined position; and stopper configured to stop said movable lever in a position different from said predetermined position.

7. The image forming apparatus of claim 1, wherein said movable lever is secured to an element mounted on said cover.

8. An image forming apparatus, comprising:

a body;

cover means for covering a portion of said body, said cover means being configured to swing to an open position and to a closed position relative to said body, said cover means including movable lever means for allowing said cover means to settle in said closed position only when said movable lever means is in a predetermined position; and a process cartridge configured to be detachably installed in said body and secured to said body when the cover means is in the closed position, said process cartridge including projection means for moving said movable lever means of said cover means to said predetermined position.

9. The image forming apparatus of claim 8, wherein said projection means is separately manufactured from said process cartridge and secured to a part of said process cartridge.

10. The image forming apparatus of claim 8, wherein said process cartridge further comprises:

handle means for being grasped by an operator, said projection means being mounted on or around said handle means.

11. The image forming apparatus of claim 10, wherein said projection means is mounted on at least one side of said handle means of said process cartridge.

12. The image forming apparatus of claim 8, wherein said movable lever means comprises:

means for permitting said cover to swing to said open position from said closed position when said process cartridge is detached from said body.

13. The image forming apparatus of claim 8, wherein said cover means further comprises:

pushing member means for pushing said movable lever means away from said predetermined position; and stopper means for stopping said movable lever means in a position different from said predetermined position.

14. The image forming apparatus of claim 8, wherein said movable lever means is secured to an element which is mounted on said cover means.

15. An image forming apparatus comprising:

a body;

a cover rotatable to an open position and a closed position relative to said body, said cover including a moveable lever configured to contact a projection of a process cartridge when the cover is rotated from the open position to the closed position and configured to move from a first position to a second position that permits the cover to rotate to the closed position when the moveable lever contacts the projection.

16. The image forming apparatus of claim 15, wherein said movable lever comprises:

a horizontal lever configured to contact said projection of the process cartridge when the cover is rotated from the open position to the closed position; and a vertical lever configured to engage a pit of the process cartridge when the lever member moves from the first position to the second position.

17. The image forming apparatus of claim 16, wherein the cover further comprises:

a spring configured to move the moveable lever from the second position to the first position when the cover is rotated from the closed position to the open position.

18. A process cartridge comprising:

an outer case defining a pit to receive a first portion of a moveable lever of an image forming apparatus cover; and a projection configured to contact a second portion of the moveable lever of the image forming apparatus cover and to move the moveable lever such that said pit receives the first portion of said moveable lever when the cover is in a closed position relative to a body of the image forming apparatus.

19. The process cartridge of claim 18, further comprising:

a fixing member attached to said outer case, said projection being fixed to said fixing member; and a handle attached to said fixing member.

20. A method for preventing the use of an unsuitable process cartridge in an image forming apparatus, comprising the steps of:

rotating a cover of the image forming apparatus from an open position to a closed position;

contacting a moveable lever of the cover with a projection of a process cartridge;

moving the movable lever from a first position to a second position; and receiving a portion of the moveable lever in a pit defined by the process cartridge when the moveable lever is moved from the first position to the second position.

* * * * *